United States Patent [19]

Ipcinski

[11] Patent Number: 4,945,195

[45] Date of Patent: Jul. 31, 1990

[54] ROTARY SWITCH

[75] Inventor: Ralph Ipcinski, Hollis, N.H.

[73] Assignee: C & K Components, Inc., Newton, Mass.

[21] Appl. No.: 325,392

[22] Filed: Mar. 20, 1989

[51] Int. Cl.[5] ..... H01H 19/60

[52] U.S. Cl. ..... 200/6 B; 200/6 BB; 200/11 R; 200/565; 200/569

[58] Field of Search ..... 200/1 R, 5 R, 6 R, 6 B, 200/6 BA, 6 BB, 6 C, 11 R, 11 E, 11 EA, 11 G, 11 J, 11 K, 11 TW, 275, 283, 284, 291, 292, 302.1, 316, 564, 565, 568, 569, 570, 571, 573; 29/622

[56] References Cited

U.S. PATENT DOCUMENTS

| | | | |
|---|---|---|---|
| 3,300,594 | 1/1967 | Paine et al. | 200/11 G X |
| 3,900,709 | 8/1975 | Sheesley et al. | 200/6 B X |
| 4,107,482 | 8/1978 | Marker | 200/6 B |
| 4,260,860 | 4/1981 | Niihama et al. | 200/6 R |
| 4,272,658 | 6/1981 | Crosby | 200/6 B |
| 4,400,597 | 8/1983 | Bruder et al. | 200/6 B |
| 4,539,444 | 9/1985 | Senoh | 200/5 R |

*Primary Examiner*—J. R. Scott

[57] ABSTRACT

A DIP coded rotary switch which has a housing, a rotor, a base, a fixed contact and a series of contact portions. The base is formed by insert molding around a unitary metal stamping. The metal stamping is then separated into the contact portions and the fixed contact. The housing is box like and has an inner surface providing a cavity, an engagement wall which extends from a circular, through first aperture to a second through aperture, the engagement wall provides a convoluted configuration facing into the cavity. Each of the contact portions has a movable contact portion and each of the movable contact portions includes a free terminal end. The terminal end of each of the movable contact portions is positioned in superimposed, spaced relation to the fixed contact portion. The rotor includes first and second spring cam portions which flexibly bear against the convoluted configuration of the engagement wall.

6 Claims, 6 Drawing Sheets

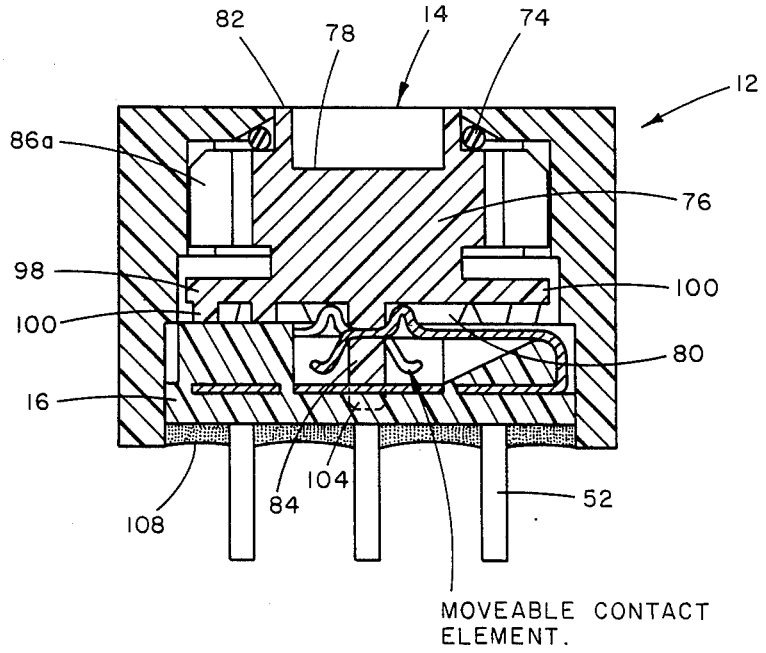

ROTARY SWITCH

BACKGROUND OF THE INVENTION

Field of the Invention

This invention relates to electrical switches and more specifically to rotary switches. It also relates to an method of forming rotary switches.

SUMMARY OF THE INVENTION

The invention disclosed herein is first directed at a lock nut comprising a housing, a rotor, a base, a fixed contact and a series of contact portions. The base is formed by insert molding around a metal stamping which is separated into contact portions and a fixed contact. The base includes an upper surface and a lower surface. A pair of first and second channels and a third channel are formed in the upper surface. Each of the first and second channels has a floor and each of the floors is provided with a portion wedge shaped in cross section. The third channel positioned in right angle relation with the first and second channels. The fixed contact portIon is positioned in the third channel with a movable contact portIon positioned under each of the first and second channels. Each of the movable contact portions is bent around the wedge shaped portion and the terminal end of each of the movable contact portions is positioned in superimposed, spaced relation to the fixed contact portion. The rotor is mounted within the housing in superposed relation to the upper surface of the base and the terminal ends of each of the movable contact portions whereby rotation of the rotor urges one of the terminal ends into engagement with the fixed contact portion.

BRIEF DESCRIPTION OF THE DRAWINGS

Further details explained below with the help of the example(s) illustrated in the attached drawings in which.

DESCRIPTION OF THE PREFERRED EMBODIMENT(S)

Figure 1:
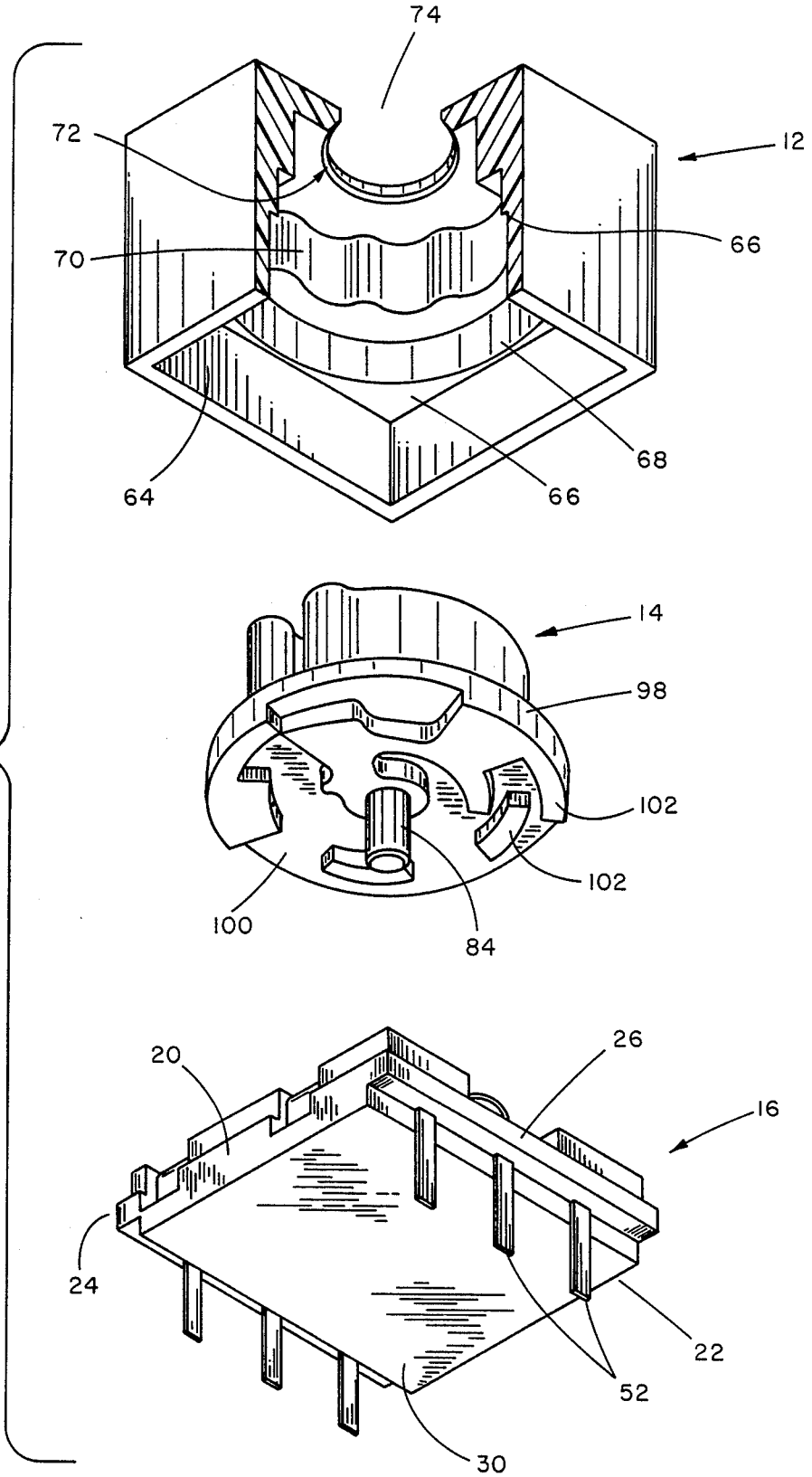
FIG. 1 is an exploded view partially broken away of a rotary switch according to the present invention.
Figure 2:
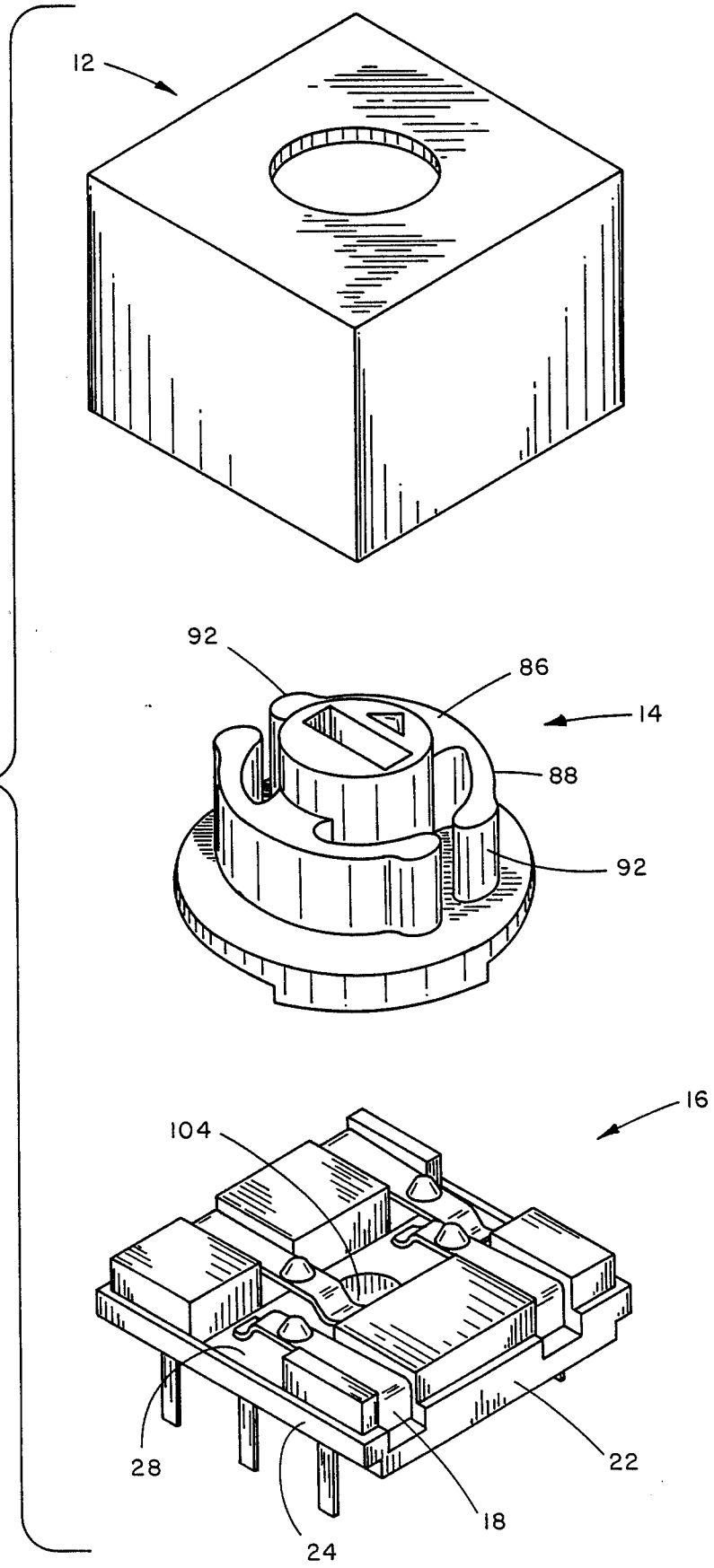
FIG. 2 is a perspective of the rotary switch shown in FIG. 1, showing the top surfaces of the main components.
Figure 3:
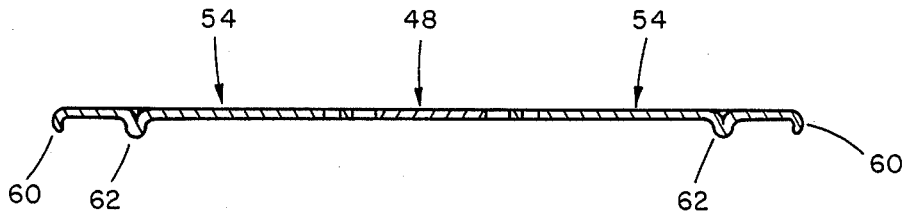
FIG. 3 is a sectional view taken on the line 3—3 of FIG 4.

There is shown in the drawings a DIP coded rotary switch 10 comprising a housing 12, a rotor 14, a base 16 and a contact assembly 18. The base 16 is formed by insert molding around the contact assembly 18.

Figure 5:
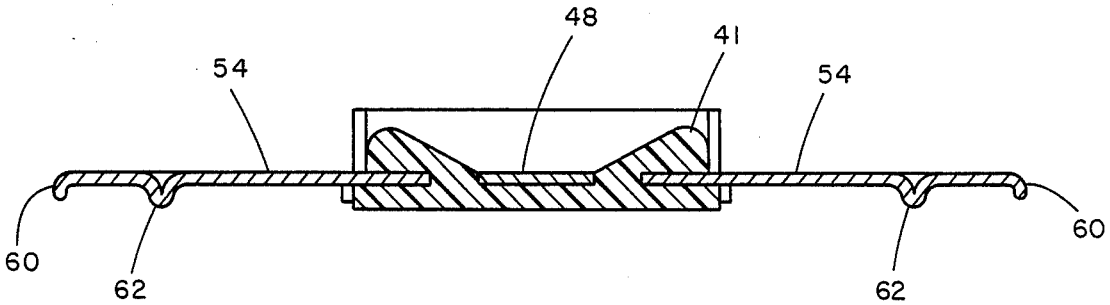
FIG. 5 is a sectional view taken on the line 5—5 of FIG. 6.
Figure 6:
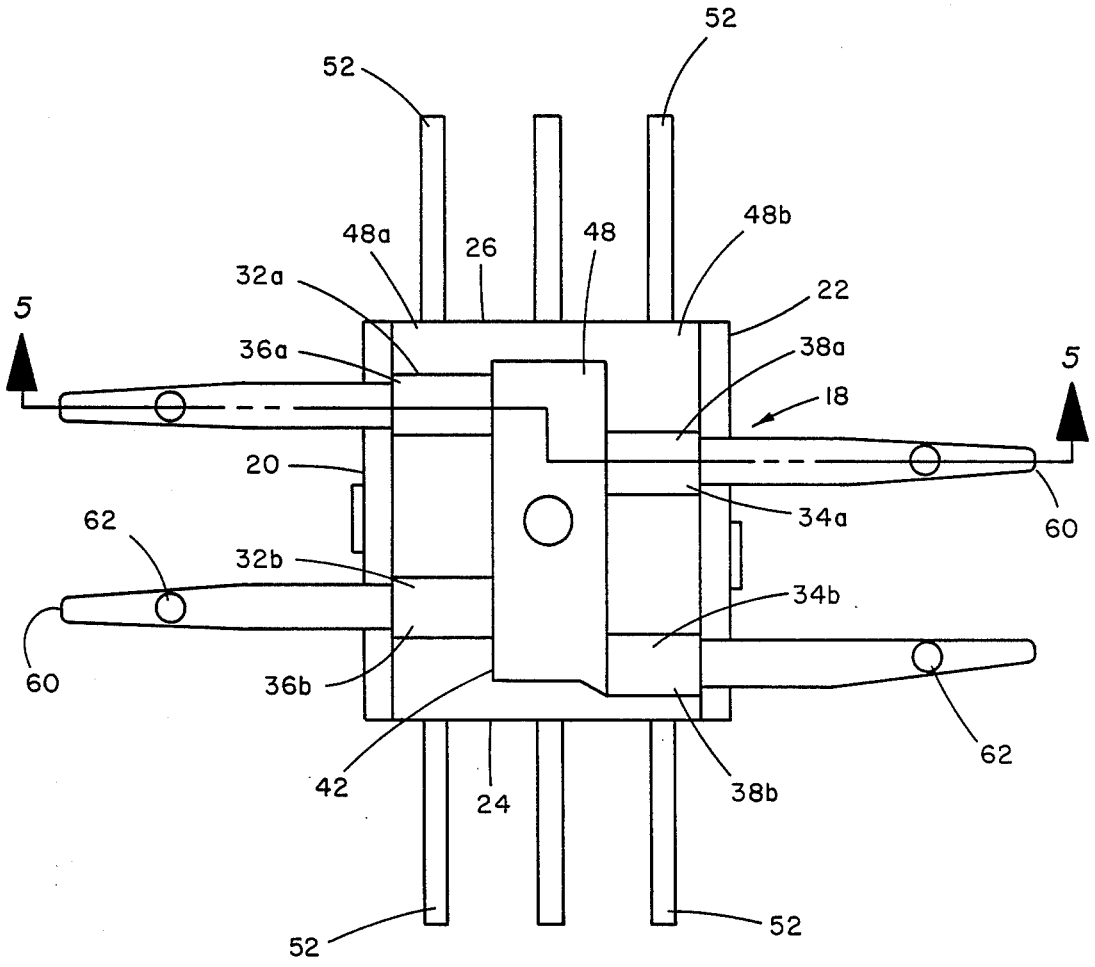
FIG. 6 is a top plan view of the formed base and of the contact assembly shown in FIG. 4.
Figure 7:
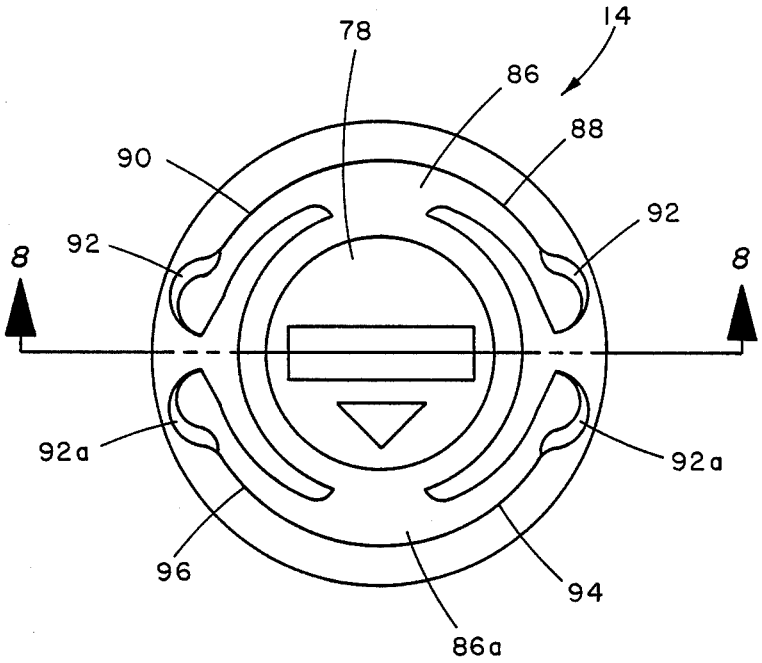
FIG. 7 is a bottom plan view of the rotor of the switch shown in FIG. 1.
Figure 8:
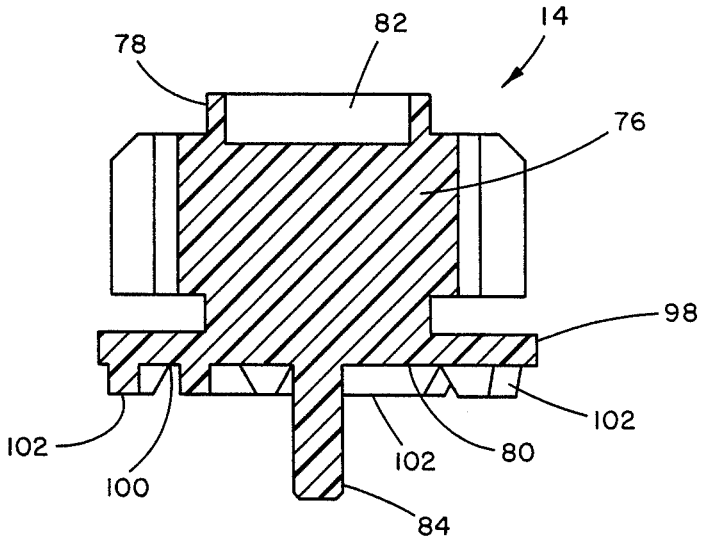
FIG. 8 is a sectional view of the rotor of the switch shown in FIG. 7.
Figure 9:
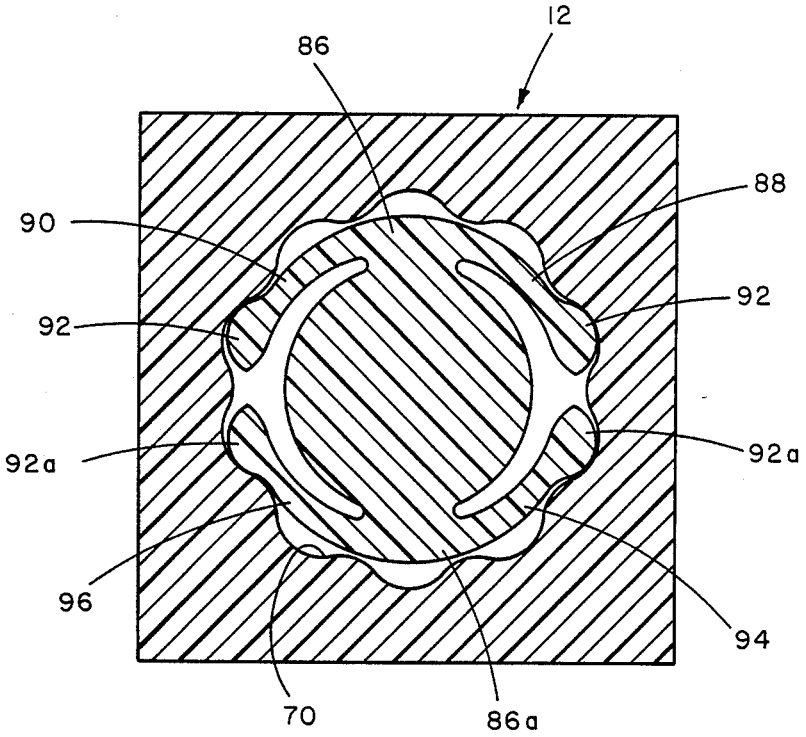
FIG. 9 is a bottom plan view of the rotor positioned in the housing of the switch shown in FIG. 1, the housing in section.

The base 16 includes a first long side edge 20, a second long side edge 22, a first side edge 24 and a second side edge 26. The first and second long side edges 20, 22 are in spaced parallel relation with each other and connected at their ends by the first and second side edge 24, 26. The base 16 also includes an upper surface 28 and a lower surface 30. The upper surface 28 has a pair of spaced rectangular ribs **40*a*, 40*b* formed in parallel relation to each other and to second long side edge 22. A pair of first channels 32*a*, 32*b* are formed in the rib 40*a* extending from the first long side edge 20 to a third channel 42 and in spaced parallel relation with the first and a second side edges 24, 26. The upper surface 28 has a pair of spaced second channels 32*a*, 32*b*, formed in the rib 40*b* extending from the second long side edge 20 to the third channel 42 and in spaced parallel relation with the first and a second side edges 24, 26. The floor 36*a*, 36*b*, 38*a*, and 38*b* of each of the first and second channels 32*a*, 32*b*, 34*a*, and 34*b* is provided with a wedge shaped portion 41 in cross section as shown in FIG. 5. The third channel 42 extends from first side edge 24 to the second side edge 26, in spaced parallel relation with the first and second long side edges 20, 22 and in right angle relation with the first and second channels 32*a*, 32*b*, 34*a* and 34*b***.

Figure 4:
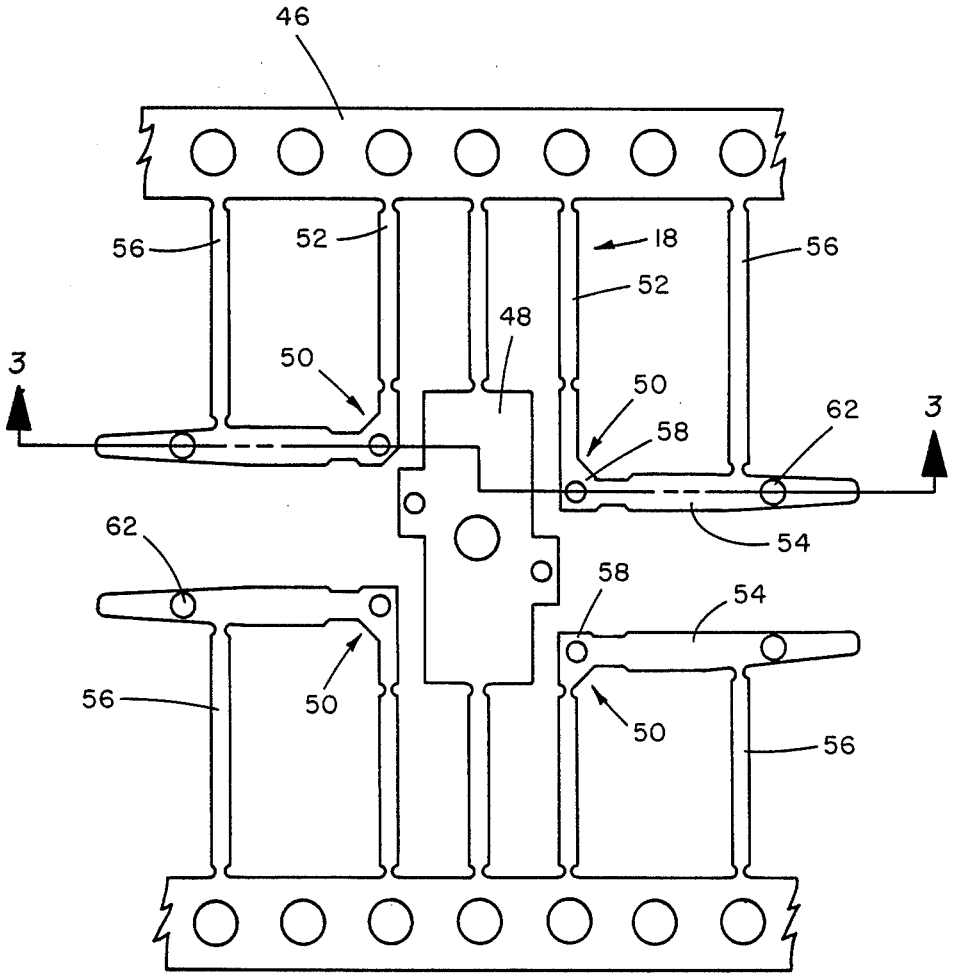
FIG. 4 is a top plan view of a portion of the contact assembly according to the present invention.

There is shown in FIG. 4 a metal stamping 44 comprising a series of the contact assemblies 18 attached to runners 46. Each of the contact assemblies 18 includes a fixed contact portion 48 and four contact portions 50. The fixed contact portion 48 is generally rectangular in configuration and is attached on one long side to a pair of contact portions 50 at the midpoint of a connecting bar 56 which in turn connects the contact portions 50 together as shown in FIG. 4. This configuration is repeated on the other long side of the fixed contact portion 48 with a second pair of contact portions 50. Each of the short sides of the fixed contact portion 48 is attached to a runner 46. The contact portions 50 each comprise a movable contact portion 54 extending in integral, right angle relation to a support portion 58. A movable contact portion 54 extends from an end of the support portion 58 to attach to one of the runners 46. Each of the movable contact portions 54 includes an arced free terminal end 60 and a hump 62 positioned between the terminal end 60 and the attachment with the connecting bar 56. The hump 62 is located in close proximity to the terminal end 60.

During the insert molding process, the metal stamping 44 is separated into the contact portions 50 and fixed contact 48 and assembled with the simultaneously formed base 16 positioning the fixed contact portion 48 in the third channel 42 with one of the movable contact portions 54 positioned under one of the channels **32*a*, 32*b*, 34*a* and 34*b* and extending beyond the area defIned by the first and second long side edges 22, 24. One pair of the terminal portions 52 extend from and beyond the first side edge 24 from between the upper surface 28 and the lower surface 30; while the other pair of terminal portion 52 extend from and beyond the second side edge 26 from between the upper surface 28 and the lower surface 30. The upper surface 28 at the first and second side edge 24, 26 extends slightly beyond the lower surface 30. The fixed contact portion 48 is positioned in the third channel 42. Each of the movable contact portions 54 is bent around the wedge shaped portion 41** formed in its respective first or second channel 32*a*, 32*b*, 34*a* and 34*b*. The terminal end 60 of each of the movable contact portions 54 is positioned in superimposed, spaced relation to the fixed contact portion 48.

The housing 12 comprises a box like configuration having an inner surface 64 including a first shoulder 66 formed within the cavity provided by the housing 12. An engagement wall 70 extends from a circular, through first aperture 68 defined by the first shoulder 66 to a second shoulder 72 which defines a second through aperture 74. The diameter of the first aperture 68 is greater than the diameter of the second aperture 74. The engagement wall 70 provides a convoluted configuration for a purpose to be setforth hereinafter. The wall of the second shoulder 72 defining the second aperture 74 is biased from the second shoulder 72 to the upper wall of the housing 12.

The rotor 14 comprises a cylindrical pillar portion 76 having a top surface 78 and a bottom surface 80. A slotted rotator element 82 is formed on the top surface 78 and a cylindrical pin 84 extends from the center of the bottom surface 80. A first spring cam portion 86 extends from the pillar portion 76, proximate the top surface 78, including a first spring wing element 88 extending from one side of the pillar portion 76 and a second spring wing element 90 extending from the other side of the pillar portion 76. The first and second wing elements 88, 90 are spaced from the pillar portion 76 and each of them includes arced, free ends 92 for a purpose to be setforth hereinafter. A second cam spring portion 86*a* extends from the opposite side of the pillar portion 76 from the first cam portion 86, proximate the top surface 78, and includes a third spring wing element 94 extending from one side of the pillar portion 76 and a fourth spring wing element 96 extending from the other side of the pillar portion 76. The third and fourth spring wing elements 94, 96 are spaced from the pillar portion 76 and each of them includes arced, free ends 92*a* for a purpose to be setforth hereinafter. A disk like cam support portion 98 circumscribes an extends radially from the pillar portion 76, proximate the bottom surface 80. The cam support portion 98 is in spaced parallel relation with the first and second wing elements 88, 90 and includes a support face 100 which faces away from the first and second wing elements 88, 90. A series of cams 102 are formed on the support face 100 in a predetermined configuration.

Figure 10:
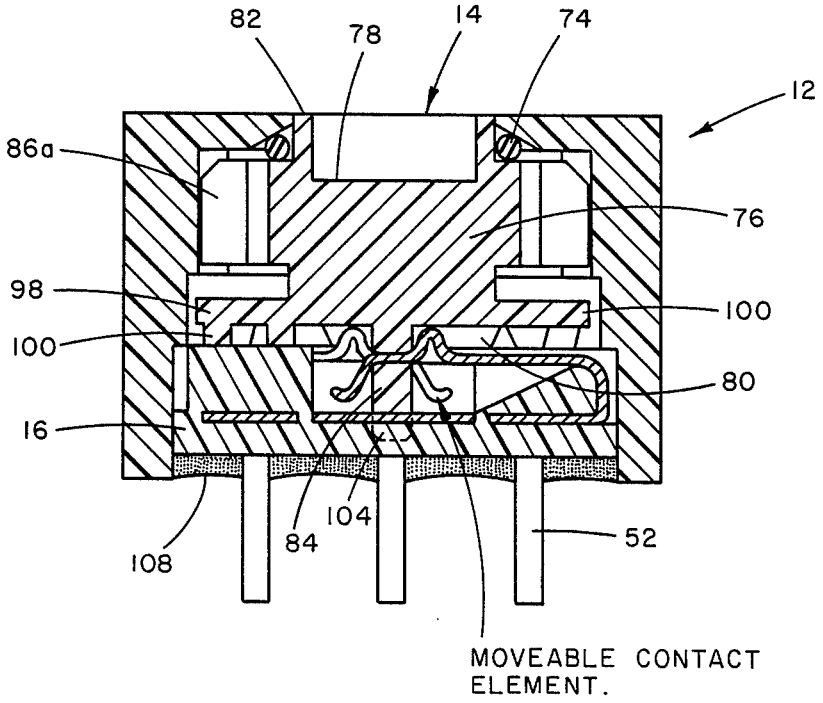
FIG. 10 is a sectional view of the switch shown in FIG. 1, the switch assembled.

Assembly of the base 16, rotor 14, an O-ring 106 and housing 12 is accomplished by positioning the tip of the pin 84 in a blind aperture 104 formed centrally in the fixed contact portion 48 and the upper surface 28 of the base 16. The housing 12 is placed over the subassembly of the base 16, O-ring 106 and the rotor 14 as shown in FIG. 10. In this position, the slotted top surface 78 of the rotor 14 is flush with the upper external surface of the housing 12 extending into the second aperture 74 and the arced, free ends 92 of the first wing element 88, second wing element 90, third wing element 94 and fourth wing element 96 are positioned on a plane whereby each of their ends 92 bear against one of the convolutions of the engagement wall 70 of the housing 12. The cams 102 are positioned on a plane in superimposed, parallel relationship with the movable contact portions 54. The cams 102 and the movable contact portions 54 are configured in such a manner that rotation of the rotor 14 will cause predetermined cams 102 to bear against predetermined movable contact portions 54 depressing them and causing the respective free terminal ends 60 to contact the fixed contact portion 48. Obviously the cams 102 and the movable contact portions 54 may be configured in several different ways and the switch 10 can be assembled with or without the O-ring 106 if desired. Sealing material 108 such as an epoxy, may be applied to the lower surface 30 of the base base 16 and the housing 12 after assembly as shown in FIG. 10.

What I claim is:

1. A DIP coded rotary switch comprising a housing, a rotor, a base, a fixed contact and a series of contact portions, the base formed by insert molding around a metal stamping, the metal stamping separated into the contact portions and the fixed contact, the base including a first long side edge, a second long side edge, a first side edge, a second side edge, an upper surface and a lower surface, the upper surface having a pair of spaced first and second ribs, formed in spaced parallel relation to each other and to the second long side edge, a pair of first channels being formed in the first rib extending from the first long side edge to a third channel and in spaced parallel relation with the first and a second side edges; the upper surface having a pair of spaced second channels formed in the second rib extending from the second long side edge to the third channel and being in spaced parallel relation with the first and a second side edges, each of the first and second channels having a floor and each of the floors being provided with a portion, the portion being wedge shaped in cross section, the third channel extending from first side edge to the second side edge, in spaced parallel relation with the first and second long side edges and in right angle relation with the first and second channels, each of the contact portions comprising a movable contact portion extending in integral, right angle relation to a support portion, each of the movable contact portions includes a free terminal end, the fixed contact portion positioned in the third channel with a movable contact portion positioned within each of the channels and each of the movable contact portions bent around the wedge shaped portion, the terminal end of each of the movable contact portions positioned in superimposed, spaced relation to the fixed contact portion, the rotor mounted within the housing in superposed relation to the upper surface of the base and to the terminal ends of each of the movable contact portions whereby rotation of the rotor urges one of the terminal ends into engagement with the fixed contact portion.

2. A DIP coded rotary switch comprising a housing, a rotor, a base, a fixed contact and a series of contact portions, the base formed by insert molding around a unitary metal stamping, the metal stamping separated into the contact portions and the fixed contact, the base having an upper surface, the housing comprising a box like configuration having an inner surface providing a cavity, an engagement wall extending from a circular, through first aperture to a second through aperture, the engagement wall providing a convoluted configuration facing into the cavity, each of the contact portions comprising a movable contact portion each of the movable contact portions including a free terminal end, the free terminal end of each of the movable contact portions positioned in superimposed, spaced relation to the fixed contact portion, the rotor comprising a cylindrical pillar portion having a top surface and a bottom surface, a slotted rotator element being formed on the top surface and a cylindrical pin extending from the center of the bottom surface, a first spring cam portion 'extending from the pillar portion, a second cam spring portion extending from the opposite side of the pillar portion from the first cam portion, proximate the top surface, a disk like cam support portion extending radially from the pillar portion, proximate the bottom surface, the cam support portion being in spaced parallel relation with the first and second wing element and including a support face facing away from the first and second wing elements, a series of cams being formed on the support face in a predetermined configuration, the rotor mounted within the housing in superposed relation to the upper surface of the base and the terminal ends of each of the movable contact portions, the cam adapted to engage the movable contact portions, the first and second cam spring portion flexibly bearing against the convoluted configuration of the engagement wall whereby rotation of the rotor urges one of the terminal ends into engagement with the fixed contact portion.

3. A DIP coded rotary switch as set forth in claim 2 wherein the circular, through first aperture being defined by a first shoulder and the second aperture being defined by a second shoulder.

4. A DIP coded rotary switch as set forth in claim 3 wherein the diameter of the first aperture being greater than the diameter of the second aperture, the wall of the second shoulder defining the second aperture being biased from the second shoulder to the upper wall of the housing.

5. A DIP coded rotary switch as set forth in claim 3 wherein the base includes an upper surface and a lower surface, a first long side edge, a second long side edge, a pair of first channels being formed in the upper surface extending from the first long side edge to a third channel and in spaced parallel relation with the first long side edge and a pair of spaced second channels being formed in the upper surface extending from the second long side edge to the third channel and in spaced parallel relation with the first and a second side edges, each of the first and second channels having a floor and each of the floors provided with a wedge shaped portion in cross section, the third channel in spaced parallel relation with the first and second long side edges and in right angle relation with the first and second channels with a movable contact portion positioned under each of the channels and each of the movable contact portions bent around the wedge shaped portion to position the free terminal end.

6. The method of forming a DIP coded rotary switch comprising the steps of:

forming a unitary metal stamping;

the metal stamping comprising a fixed contact portion and a movable contact portion;

the metal stamping insert molded to form the base of the dip coded rotary switch around a portion of the metal stamping;

separating the fixed contact portion from the movable contact portion;

forming a housing;

forming a rotor;

bending appropriate portions of the movable contact portion to provide a movable contact and a terminal;

assembling the rotor within the housing;

assembling the sub assembly of the rotor and the housing with the sub assembly of the fixed contact portion, the movable contact portion, and the base;

and sealing the housing to the base.

* * * * *